United States Patent [19]

Park

[11] Patent Number: 4,766,279

[45] Date of Patent: Aug. 23, 1988

[54] HEAT VARIATION DETECTING CIRCUIT FOR THE MICROWAVE OVEN

[75] Inventor: Jong-In Park, Kyungsangnam-do, Rep. of Korea

[73] Assignee: Goldstar Co., Ltd., Seoul, Rep. of Korea

[21] Appl. No.: 946,024

[22] Filed: Dec. 24, 1986

[30] Foreign Application Priority Data

Dec. 27, 1985 [KR] Rep. of Korea ..... 17713

[51] Int. Cl.[4] ..... H05B 6/68

[52] U.S. Cl. ..... 219/10.55 B; 219/10.55 R

[58] Field of Search ..... 219/10.55 B, 10.55 R, 219/497, 499; 374/10.55 M, 10.55 E; 340/588, 589

[56] References Cited

U.S. PATENT DOCUMENTS 4,463,238 7/1984 Tanabe ..... 219/10.55 B
4,584,448 4/1986 Tanabe ..... 219/10.55 B
4,591,684 5/1986 Tanabe ..... 219/10.55 B

*Primary Examiner*—G. P. Tolin
*Assistant Examiner*—Leon K. Fuller
*Attorney, Agent, or Firm*—Birch, Stewart, Kolasch & Birch

[57] ABSTRACT

A heat variation detecting circuit, for use with a heat sensor in a microwave oven, comprises a heat sensor, temperature memorizing registers and control comparators. The temperature sensed by the heat sensor is converted via an A/D converter into a digital signal and is memorized in a present temperature register. A buffer register and a prior temperature register will then compare via at a comparator the present and prior temperatures to give a Reset or Enable signal at the comparator in accordance with coincidence or noncoincidence of the temperatures between the present and the prior temperatures in order to control a temperature error counter. The output of the temperature error counter together with the output of the presetting register controls a comparing unit for producing a signal for control of the Magnetron.

3 Claims, 3 Drawing Sheets

HEAT VARIATION DETECTING CIRCUIT FOR THE MICROWAVE OVEN

BRIEF SUMMARY OF INVENTION

The present invention relates to a heat variation detecting circuit which senses the heat sensor's failure during a cooking operation. This failure may possibly be caused by an abnormality in a microwave oven and upon such failure, the whole operation of the oven will immediately stop.

DESCRIPTION OF THE BACKGROUND ART

A conventional microwave oven that employ a heat sensor cannot, if the heat sensor fails during a cooking operation, sense the increased heating of the food during cooking which so often results in overdoing the food or in an extreme case, results in burning the food to develop a fire.

SUMMARY OF THE INVENTION

The present invention is devised to eliminate the above-discussed problems found in a conventional microwave oven. According to the invention, the temperature during a cooking operation is continuously sensed by a heat sensor to be compared with the prior sensed temperature in order to check for variations in the temperature. The absence of heat variation in the sensor shall be interpreted as a failure or as trouble in the heat sensor and will result in an immediate stop for the whole operation of the oven and will therefore prevent the overdoing of the cooking food or the danger of developing fire due to overheating.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
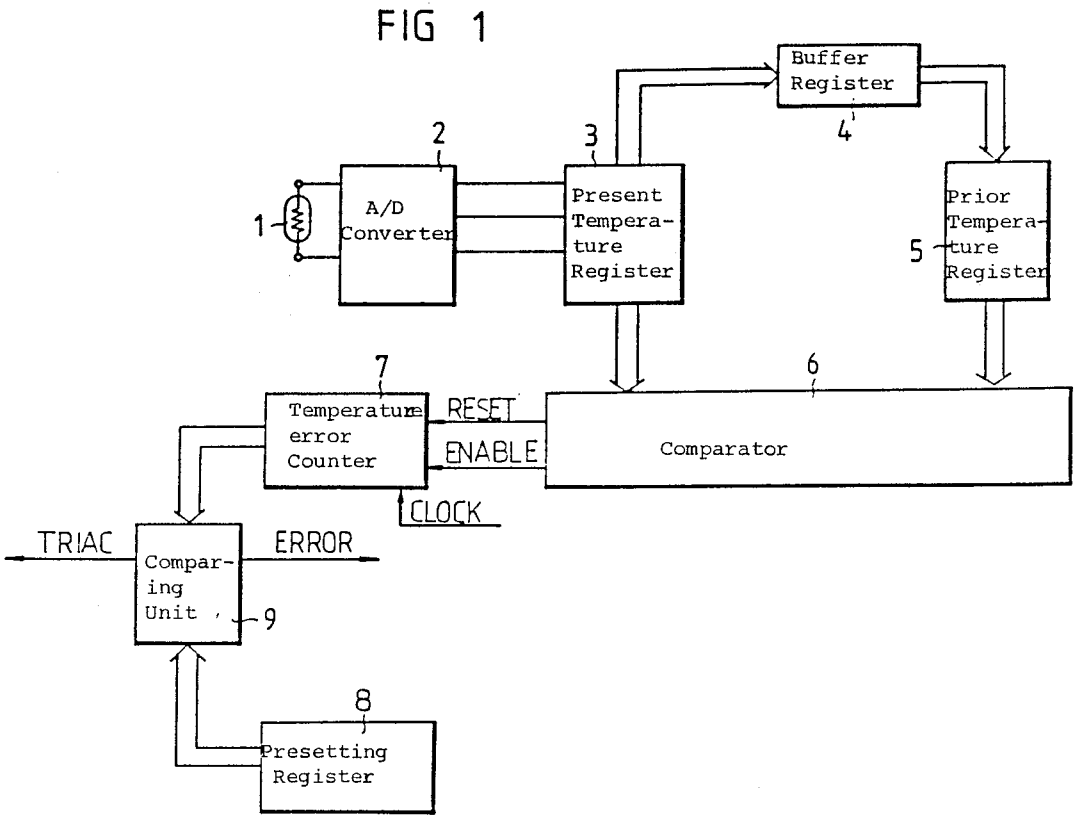
FIG. 1 shows a block diagram of a heat variation detecting circuit for a microwave oven according to the present invention.

Numerals and codes in the drawings indicate the following: Numeral 1 indicating a heat sensor; 2 an A/D (Analog/Digital) converter; 3 a present temperature register; 4 a buffer register; 5 a prior temperature register; 6 a comparator; 7 a temperature error counter; 8 a presetting register; 9 a comparing unit; $Ex_1$ to $Ex_8$ for exclusive NOR gates; $IC_1$ for an AND gate; and $IC_2$ for an inverter.

The invention shall be described with detail in reference to the drawings.

As shown in the block diagram of FIG. 1, an embodiment of the present invention comprises a heat sensor 1, an A/D converter 2, a present temperature register 3, a buffer register 4, a prior temperature register 5, a comparator 6 which is directly connected to the register 3 and is connected via said buffer register 4 and prior temperature register 5 to the said register 3, a temperature error counter 7, a presetting register 8 and a comparing unit 9 which is connected via said counter 7 to said comparator 6 and also connected to said presetting register 8.

Figure 2:
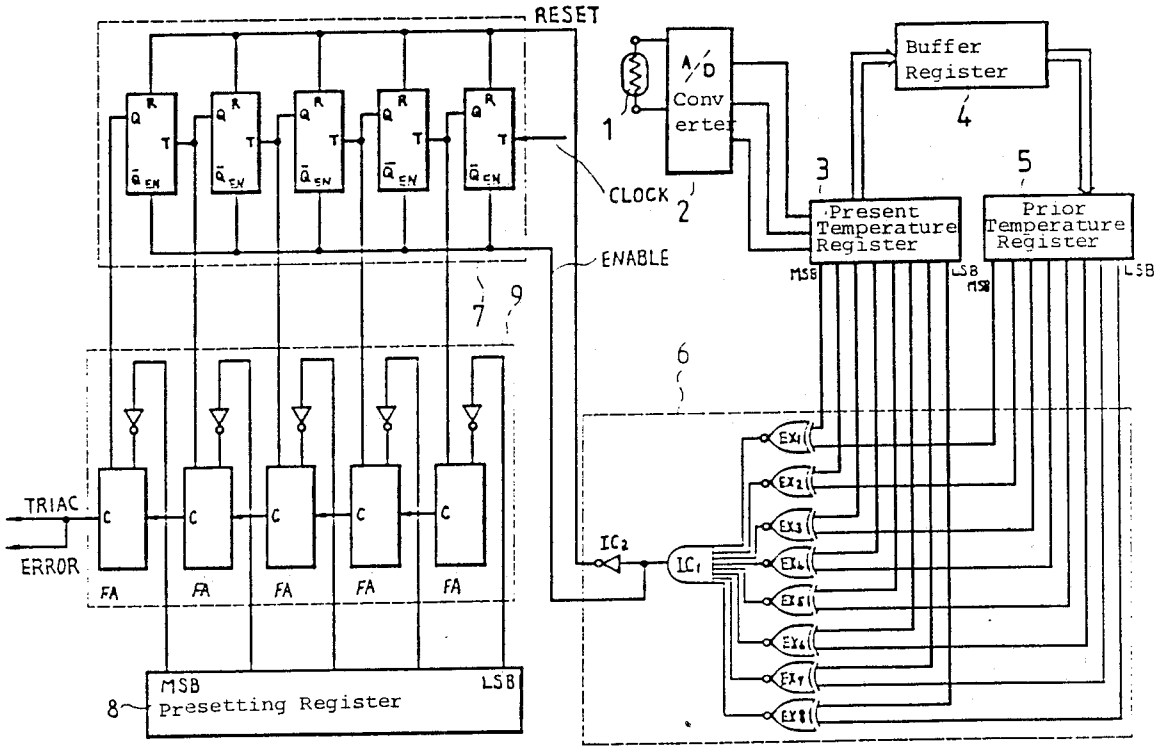
FIG. 2 shows the detail of the heat variation detecting circuit of the present invention.

The structure of the invention shall be described in more detail with reference to FIG. 2. The heat sensor 1 is connected to the A/D converter 2 which is connected to the present temperature register 3. This register 3 is connected via the buffer register 4 to the prior temperature register 5. The 8-bit output terminals of both the register 3 and the register 5 are respectively connected to exclusive NOR gates $Ex_1$ to $Ex_8$, in the comparator 6, whose output terminals are connected to an AND gate $IC_1$. This AND date $IC_1$ outputs an ENABLE signal via an inverter $IC_2$ gives a RESET signal to be applied to the temperature error counter 7, which is formed of T flip-flops. The output signals at Qs of the T flip-flops are synchronized by the input signals at Ts of the Clock to be applied to the Full Adders (FAs) of the comparing unit 9 to which the inverted preset value of the presetting register 8 is applied to give the carry outputs of the FAs and to output signals for control of TRIAC for the Magnetron and for error warning.

Figure 3:
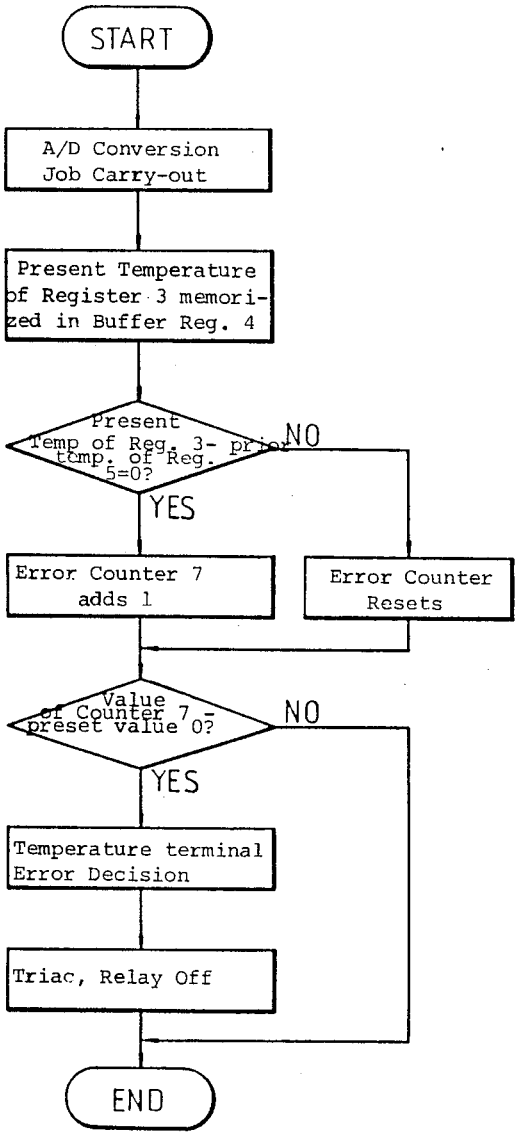
FIG. 3 shows the operation flow chart of the circuit in FIG. 2.

According to the block diagram for the control of the invention in FIG. 1, variation of the resistence sensed in the heat sensor 1 results in variation of the input voltage of the A/D converter 2. The analog signal of the present temperature sensed in the sensor 1 converts into a digital signal at the A/D converter 2 to be memorized at the present temperature register 3 and compared with the prior temperature of the register 5 at the comparator 6. As shown in FIG. 3, coincidence of the 8-bit temperature value of the present temperature register 3 with the 8-bit temperature value of the prior temperature register 8 results in a "high" state of respective outputs of the exclusive NOR gates $Ex_1$ to $Ex_8$ to keep the output of the AND gate $IC_1$ in a "high" state and to drive the T flip-flops of the temperature error counter by an ENABLE signal. However, non-coincidence of such values results in a "low" state of the AND gate $IC_1$ output to invert the output via the inverter $IC_2$ into a "high" state and to reset T flip-flops of the error counter 7 through a RESET signal.

A difference between the temperature of the present temperature register 3 and that of the prior temperature register 5 results in application of a RESET signal of the comparator 6 to the error counter 7 and makes the output of the counter 7 become "0". On the other hand, any coincidence between the temperatures of the registers 3 and 5 results in application of an ENABLE signal of the comparator 6 to the error counter 7 to make it start counting. Simultaneously, the present temperature of the register 3 is memorized in the buffer register 4, and upon receiving another and next present temperature by the register 3, the temperature memorized at the buffer register 4 is transferred to the prior temperature register 5 to repeat the cycle of operation as described hereinbefore.

Continued coincidence of temperature between the register 3 and the register 5 causes the comparator 6 to output an ENABLE signal and makes the error counter 7 continue counting to give increased output. An excess increase of value will result over the preset output value of the presetting register 8, of which preset value is arranged to complement via an inverter to be added to the output value of the error counter 7 at the FA which acts as a subtractor, causes outputs at Carry Output terminals of the FAs of the comparing unit 9 to put off TRIAC for power control of the Magnetron and to simultaneously give an error signal for outputting a warning.

In short, non-variation of heat sensing for a certain period of continuous power output in a microwave oven certainly indicates trouble in the heat sensor 1 or A/D converter 2. If such trouble is detected, the microwave oven is arranged to terminate operation and to output an error signal to warn the user.

Consequently, the present invention eliminates the possibility of overdoing foods in cooking or causing a fire due to a failure of the heat sensor in the microwave oven and thereby improves and enhances the reliability and effectiveness of the oven.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A heat variation detection circuit for use with a microwave oven comprising:

heat sensor means for detecting temperature in said microwave oven and for outputting signals in response thereto;

present temperature register means for determining a present temperature value of said microwave oven in response to said signals from said heat sensor means, said present temperature register means storing said present temperature value for a predetermined period of time and thereafter outputting said present temperature value;

prior temperature register means for receiving said present temperature value output from said present temperature register means and for storing said present temperature value as a prior temperature value;

first comparator means for comparing said present temperature value stored in said present temperature register means with at least a last prior temperature value input to said prior temperature register means, said first comparator means thereafter outputting one of a RESET signal and an ENABLE signal in response to said comparing, said RESET signal being output when said present temperature value is noncoincident with said prior temperature value, said ENABLE signal being output when said present temperature value is coincident with said prior temperature value;

error counter means for receiving said RESET signals and said ENABLE signals from said first comparator means and for outputting a counter value, each successive ENABLE signed causing said error counter means to output an increasing counter value;

preset register means for storing and outputting a preset value; and second comparator means for receiving said counter values from said error counter means and for receiving said preset value from said preset register means, said second comparator means terminating operation of said microwave oven in response to said counter value and said preset value such that when said heat sensor means fails to detect a change in temperature for a selected period of time during operation of said microwave oven, said heat sensor means is determined to be defective and said microwave oven operation is terminated.

2. The heat variation detection circuit as recited in claim 1 wherein said second comparator means further outputs an error signal for warning a user that said heat sensor means is defective.

3. The heat variation detection circuit as recited in claim 1 further comprising a buffer register for receiving said present temperature value from said present temperature register means and thereafter transferring said present temperature value to said prior temperature register means.

* * * * *